US011072748B2

(12) United States Patent
Koseoglu et al.

(10) Patent No.: US 11,072,748 B2
(45) Date of Patent: Jul. 27, 2021

(54) SELECTIVE REFORMING PROCESS TO PRODUCE GASOLINE BLENDING COMPONENTS AND AROMATICS

(71) Applicant: Saudi Arabian Oil Company, Dhahran (SA)

(72) Inventors: Omer Refa Koseoglu, Dhahran (SA); Ali H. Al-Shareef, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/707,534

(22) Filed: Dec. 9, 2019

(65) Prior Publication Data

US 2021/0171841 A1 Jun. 10, 2021

(51) Int. Cl.

| | |
|---|---|
| ***C10G 61/04*** | (2006.01) |
| ***C10G 35/04*** | (2006.01) |
| *C10G 21/22* | (2006.01) |
| *C10G 21/16* | (2006.01) |
| *C10G 21/20* | (2006.01) |

(52) U.S. Cl.

CPC ..... *C10G 61/04* (2013.01); *C10G 35/04* (2013.01); *C10G 21/16* (2013.01); *C10G 21/20* (2013.01); *C10G 21/22* (2013.01); *C10G 2300/1096* (2013.01)

(58) Field of Classification Search

CPC ..... C10G 21/16; C10G 21/20; C10G 21/22; C10G 35/04; C10G 61/04; C10G 2300/1096

See application file for complete search history.

(56) References Cited

U.S. PATENT DOCUMENTS

| | | | |
|---|---|---|---|
| 3,000,810 | A | 9/1961 | Christensen et al. |
| 3,821,104 | A | 6/1974 | Hughes et al. |
| 4,594,144 | A | 6/1986 | James, Jr. et al. |
| 5,211,838 | A | 5/1993 | Staubs et al. |

(Continued)

FOREIGN PATENT DOCUMENTS

| | | | |
|---|---|---|---|
| EP | 0629683 | A1 | 12/1994 |
| JP | 2007191591 | A | 8/2007 |

(Continued)

OTHER PUBLICATIONS

Reddoch, I.A. et al. (1983) Separation of Normal Paraffins from Isoparaffins, The Eleventh Australian Conferenceon Chemical Engineering, Brisbane, Sep. 4-7, pp. 673-680.*

(Continued)

*Primary Examiner* — Brian A McCaig

(74) *Attorney, Agent, or Firm* — Abelman, Frayne and Schwab

(57) ABSTRACT

Improved catalytic reforming processes and systems employ reforming reactors in a more efficient manner and can avoid problems associated with yield loss. Aromatics and isoparaffins are separated prior to passing to a reforming unit. An integrated process for producing gasoline blending components includes: separating a naphtha feedstream into an aromatic-rich stream and an aromatic-lean stream; separating the aromatic-lean stream into an isoparaffin-rich stream and an isoparaffin-lean stream; and catalytically reforming the isoparaffin-lean stream to produce a reformate stream.

19 Claims, 5 Drawing Sheets

(56) References Cited

U.S. PATENT DOCUMENTS

| | | | | |
|---|---|---|---|---|
| 5,672,265 | A | 9/1997 | Schmidt et al. | |
| 5,858,209 | A | 1/1999 | Schmidt et al. | |
| 2016/0369188 | A1* | 12/2016 | Housmans | C10G 67/0445 |

FOREIGN PATENT DOCUMENTS

| | | | | |
|---|---|---|---|---|
| WO | WO 2012/135111 | A2 * | 10/2012 | C10G 21/28 |
| WO | 2016064646 | A1 | 4/2016 | |
| WO | 2016162887 | A1 | 10/2016 | |
| WO | 2017196619 | A1 | 11/2017 | |

OTHER PUBLICATIONS

PCT International Search Report and Written Opinion from corresponding PCT Application No. PCT/US2020/063021 dated Mar. 11, 2021.

* cited by examiner

SELECTIVE REFORMING PROCESS TO PRODUCE GASOLINE BLENDING COMPONENTS AND AROMATICS

RELATED APPLICATIONS

Not applicable.

BACKGROUND OF THE INVENTION

Field of the Invention

The present invention relates to conversion of gasoline-range hydrocarbons, and more particular to improved processes integrating catalytic reforming of gasoline-range hydrocarbons.

Description of Related Art

Catalytic reforming of hydrocarbon feedstocks in the naphtha/gasoline range is a major conversion process in petroleum refinery and petrochemical industries. Catalytic reforming is practiced in nearly every significant petroleum refinery in the world to produce aromatic intermediates for the petrochemical industry or gasoline components with high resistance to engine knock. Naphtha feeds to catalytic reforming include heavy straight run naphtha. Low octane naphtha is converted into high-octane motor gasoline blending stock and aromatics rich in benzene, toluene, and xylene with hydrogen and liquefied petroleum gas as a byproduct. With the fast growing demand in aromatics and demand of high-octane number motor gasoline blending stock, catalytic reforming is likely to remain one of the most important unit processes in the petroleum and petrochemical industry.

In catalytic reforming, a naphtha stream is typically first hydrotreated in a hydrotreating unit to produce a hydrotreated naphtha stream. The hydrotreating unit operates according to certain conditions, including temperature, pressure, hydrogen partial pressure, liquid hourly space velocity (LHSV), and catalyst selection and loading, which are effective to remove at least enough sulfur and nitrogen to meet requisite product specifications. For instance, hydrotreating in conventional naphtha reforming systems generally occurs under relatively mild conditions that are effective to remove sulfur and nitrogen to less than 0.5 ppmw levels.

There are several types of catalytic reforming process configurations, which typically differ in the manner in which they regenerate the reforming catalyst to remove the coke formed in the reactors. Commercially available catalytic reforming processes including: Rheniforming® (Chevron), Powerforming (Exxonmobil), CCR Platforming (UOP) and Octanizing (IFP/Axen). Catalyst regeneration, which involves combusting detrimental coke in the presence of oxygen, includes a semi-regenerative process, cyclic regeneration, and continuous catalyst regeneration (CCR). Semi-regeneration is the simplest configuration, and the entire unit, including all reactors in the series, is shut-down for catalyst regeneration in all reactors. The time between two regenerations is called a cycle. The catalyst retains its usefulness over multiple regeneration cycles. Cyclic configurations utilize an additional "swing" reactor to permit one reactor at a time to be taken off-line for regeneration while the others remain in service. Cyclic reformers run under more severe operating conditions for improved octane number and yields. Individual reactors are taken offline by a special valving and manifold system and regenerated while the other reformer unit continues to operate. Continuous catalyst regeneration configurations, which are the most complex, provide for essentially uninterrupted operation by catalyst removal, regeneration and replacement. In these reformers, the catalyst is in a moving bed and regenerated frequently. This allows operation at much lower pressure with a resulting higher product octane, C5+, and hydrogen yield. These types of reformers are radial flow and are either separated as in regenerative unit or stacked one above the other. While continuous catalyst regeneration configurations include the ability to increase the severity of the operating conditions, due higher catalyst activity, the associated capital investment is necessarily higher.

The hydrotreated naphtha stream is reformed in a reforming unit such as any of those described above to produce a gasoline reformate product stream. The reformate is sent to the gasoline pool, or to aromatics extraction complex before sending the raffinate to the gasoline pool, to be blended with other gasoline components to meet the required specifications. Some gasoline blending pools include $C_4$ and heavier hydrocarbons having boiling points of less than about 205° C. Catalytic reforming is typically used for treatment of feedstocks rich in paraffinic and naphthenic hydrocarbons. In catalytic reforming, diverse reactions occur, including dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. A particular hydrocarbon/naphtha feed molecule may undergo more than one category of reaction and/or may form more than one product. Basically, the process re-arranges or re-structures the hydrocarbon molecules in the naphtha feedstocks as well as breaking some of the molecules into smaller molecules. Catalytic reforming converts low octane normal paraffins to isoparaffins and naphthenes. Naphthenes are converted to higher octane aromatics. The aromatics are left essentially unchanged, or some may be hydrogenated to form naphthenes due to reverse reactions taking place in the presence of hydrogen.

While existing catalytic reforming processes are suitable for their intended purposes, a need remains in the art for efficiency improvements without loss of contribution to the gasoline pool, or an equivalent contribution to other petrochemical feedstock pools.

SUMMARY OF THE INVENTION

The improved catalytic reforming processes herein can use existing or future developed reforming reactors in a more efficient manner and can avoid problems associated with yield loss. Aromatics and isoparaffins have high octane numbers and there is no need to send these streams to a reforming unit. The current practice leads to unnecessarily higher requisite capacity for the reforming unit, and corresponding catalyst and hydrogen requirements. In addition, isoparaffins are subject to cracking in the reforming unit resulting in yield loss.

An integrated process for producing gasoline blending components includes: separating a naphtha feedstream into an aromatic-rich stream and an aromatic-lean stream; separating the aromatic-lean stream into an isoparaffin-rich stream and an isoparaffin-lean stream; and catalytically reforming the isoparaffin-lean stream to produce a reformate stream. In certain embodiments, all or a portion of the isoparaffin-rich stream is recovered and used as gasoline blending components. In certain embodiments, all or a portion of the aromatic-rich stream are recovered and used as gasoline blending components. In certain embodiments, all or a portion of the aromatic-rich stream is passed to an aromatic complex for recovery of aromatic products. In certain embodiments, all or a portion of the reformate stream is recovered and used as gasoline blending components. In certain embodiments, all or a portion of the reformate stream is passed to the step of separating the naphtha feedstream. In certain embodiments, all or a portion of the isoparaffin rich stream is separated into a light isoparaffin rich stream and a heavy isoparaffin rich stream, wherein at least a portion of the light isoparaffin rich stream is recovered and used as gasoline blending components, and at least a portion of the heavy isoparaffin rich stream is passed to the step of catalytically reforming.

An integrated system for producing gasoline blending components includes: a first separation zone operable to separate a naphtha feedstream into an aromatic-rich stream and an aromatic-lean stream, the first separation zone comprising one or more feed inlets in fluid communication with a source of the naphtha feedstream, one or more first outlets for discharging the aromatic-rich stream, one or more second outlets for discharging the aromatic-lean stream; a second separation zone operable to separate the aromatic-lean stream into an isoparaffin-rich stream and an isoparaffin-lean stream, the second separation zone comprising one or more inlets in fluid communication with the second outlet of the first separation zone, one or more first outlets for discharging the isoparaffin-rich stream, and one or more second outlets for discharging the isoparaffin-lean stream; and a catalytic reforming zone operable to produce a reformate comprising at least one inlet in fluid communication with the second outlet of the second separation zone; and at least one outlet for discharging reformate. In certain embodiments, a gasoline pool is included comprising at least one inlet in fluid communication with the first outlet of the second separation zone. In certain embodiments, a gasoline pool is included comprising at least one inlet in fluid communication with the first outlet of the first separation zone. In certain embodiments, a gasoline pool is included comprising at least one inlet in fluid communication with the catalytic reforming zone outlet. In certain embodiments, an aromatic complex is included comprising at least one inlet in fluid communication with the first outlet of the first separation zone, and at least one outlet for discharging aromatic products. In certain embodiments, the catalytic reforming zone outlet is in fluid communication with the feed inlet of the first separation zone. In certain embodiments, a third separation zone is include that is operable to separate the paraffin-rich stream into a light isoparaffin-rich stream and a heavy isoparaffin-rich stream, wherein the third separation zone has one or more inlets in fluid communication with the first outlet of the second separation zone, one or more first outlets for discharging the light isoparaffin-rich stream, and one or more second outlets for discharging the heavy isoparaffin-rich stream, and wherein the second outlet of the third separation zone is in fluid communication with the catalytic reforming zone inlet.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
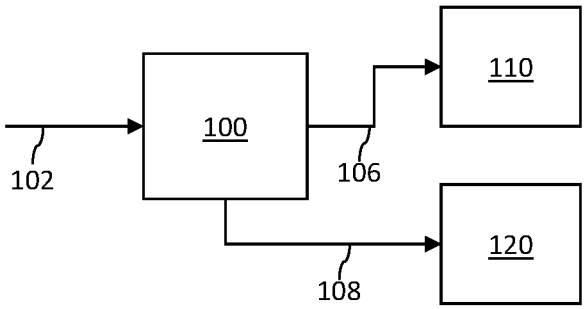
FIG. 1 (Prior Art)
FIG. 1 is a process flow diagram of a conventional catalytic reforming process and system.

As used herein, the term "stream" (and variations of this term, such as hydrocarbon stream, feed stream, product stream, and the like) may include one or more of various hydrocarbon compounds, such as straight chain, branched or cyclical alkanes, alkenes, alkadienes, alkynes, alkylaromatics, alkenyl aromatics, condensed and non-condensed di-, tri- and tetra-aromatics, and gases such as hydrogen and methane, C2+ hydrocarbons and further may include various impurities.

The term "zone" refers to an area including one or more equipment, or one or more sub-zones. Equipment may include one or more reactors or reactor vessels, heaters, heat exchangers, pipes, pumps, compressors, and controllers. Additionally, an equipment, such as reactor, dryer, or vessels, further may include one or more zones.

Volume percent or "V %" refers to a relative value at conditions of 1 atmosphere pressure and 15° C.

The phrase "a major portion" with respect to a particular stream or plural streams, or content within a particular stream, means at least about 50 wt % and up to 100 wt %, or the same values of another specified unit.

The phrase "a significant portion" with respect to a particular stream or plural streams, or content within a particular stream, means at least about 75 wt % and up to 100 wt %, or the same values of another specified unit.

The phrase "a substantial portion" with respect to a particular stream or plural streams, or content within a particular stream, means at least about 90, 95, 98 or 99 wt % and up to 100 wt %, or the same values of another specified unit.

The phrase "a minor portion" with respect to a particular stream or plural streams, or content within a particular stream, means from about 1, 2, 4 or 10 wt %, up to about 20, 30, 40 or 50 wt %, or the same values of another specified unit.

The term "rich" means that at least a major portion, a significant portion or a substantial portion of a stream is composed of a specified compound or class of compounds, as a mole percentage or a weight percentage.

The term "lean" means that no more than a minor portion of a stream is composed of a compound or class of compounds, as a mole percentage or a weight percentage.

The modifying term "straight run" is used herein having its well-known meaning, that is, describing fractions derived directly from the atmospheric distillation unit, optionally subjected to steam stripping, without other refinery treatment such as hydroprocessing, fluid catalytic cracking or steam cracking. An example of this is "straight run naphtha" and its acronym "SRN" which accordingly refers to "naphtha" defined herein that is derived directly from the atmospheric distillation unit, optionally subjected to steam stripping, as is well known.

The term "naphtha" as used herein refers to hydrocarbons boiling in the range of about 20-220, 20-210, 20-200, 20-190, 20-180, 20-170, 32-220, 32-210, 32-200, 32-190, 32-180, 32-170, 36-220, 36-210, 36-200, 36-190, 36-180 or 36-170° C.

The term "light naphtha" as used herein refers to hydrocarbons boiling in the range of about 20-110, 20-100, 20-90, 20-88, 32-110, 32-100, 32-90, 32-88, 36-110, 36-100, 36-90 or 36-88° C.

The term "heavy naphtha" as used herein refers to hydrocarbons boiling in the range of about 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180 or 110-170° C.

The terms "reformate" as used herein refer to a mixture of hydrocarbons that are rich in aromatics, and are intermediate products and/or blending components in the production of chemicals and/or gasoline, and include hydrocarbons boiling in the range of about 30-220, 40-220, 30-210, 40-210, 30-200, 40-200, 30-185, 40-185, 30-170 or 40-170° C.

The term "light reformate" as used herein refers to reformates boiling in the range of about 30-110, 30-100, 30-90, 30-88, 40-110, 40-100, 40-90 or 40-88° C.

The term "heavy reformate" as used herein refers to reformates boiling in the range of about 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180 or 110-170° C.

The term "aromatic products" includes $C_6$-$C_8$ aromatics, such as benzene, toluene, mixed xylenes (commonly referred to as BTX), or benzene, toluene, ethylbenzene and mixed xylenes (commonly referred to as BTEX), and any combination thereof.

For convenience, a conventional gasoline reforming process is shown and described with reference to FIG. 1. Conventionally a naphtha feed 102 that contains aromatics, normal paraffins, isoparaffins and naphthenes, is routed to a reforming unit 100. The source of naphtha can be, for example, a distillation column where the initial source is crude oil (straight run naphtha), hydrotreated straight run naphtha, another naphtha hydrotreater, wild naphtha from a hydrocracking process, or coker naphtha.

Reactions taking place in the catalytic reforming unit 100 include dehydrogenation of naphthenes to aromatics, isomerization of n-paraffins to iso-paraffins, dehydrocyclization of paraffins to aromatics, all of which are desirable; and hydrocracking of paraffins to lower molecular weight compounds, which are not desirable. Dehydrogenation and dehydrocyclization reactions are highly endothermic and result in a decrease in reaction temperature. A light reformate stream 106 is routed to a gasoline component blending pool, or gasoline pool, unit 110. A heavy reformate stream 108 is passed to an aromatic complex 120 (also known as an aromatics recovery complex) for recovery of aromatic products.

In general, the operating conditions for a reforming unit include a temperature in the range of from about 260-560, 400-560 or 450-560° C.; a pressure in the range of from about 1-50, 1-20, 1-10, 4-50, 4-20 or 4-10 bars; and a liquid hourly space velocity in the range of from about 0.5-40, 0.5-10, 0.5-4, or 0.5-2 $h^{-1}$. Cyclic and CCR process designs include online catalyst regeneration or replacement, and accordingly the lower pressure ranges as indicated above are suitable. For instance, CCRs can operate in the range of about 5 bar, while semi regenerative systems operate at the higher end of the above ranges, with cyclic designs typically operating at a pressure higher than CCRs and lower than semi regenerative systems.

An effective quantity of reforming catalyst is provided. Such catalysts include mono-functional or bi-functional reforming catalysts, which generally contain one or more active metal component of metals or metal compounds (oxides or sulfides) selected from the Periodic Table of the Elements IUPAC Groups 8-10. A bi-functional catalyst has both metal sites and acidic sites. In certain embodiments, the active metal component can include one or more of Pt, Re, Au, Pd, Ge, Ni, Ag, Sn, Ir or halides. The active metal component is typically deposited or otherwise incorporated on a support, such as amorphous alumina, amorphous silica alumina, zeolites, or combinations thereof. In certain embodiments, Pt or Pt-alloy active metal components that are supported on alumina, silica or silica-alumina are effective as reforming catalyst. The hydrocarbon/naphtha feed composition, the impurities present therein, and the desired products will determine such process parameters as choice of catalyst(s), process type, and the like. Types of chemical reactions can be targeted by a selection of catalyst or operating conditions known to those of ordinary skill in the art to influence both the yield and selectivity of conversion of paraffinic and naphthenic hydrocarbon precursors to particular aromatic hydrocarbon structures.

The improved processes for gasoline production that are disclosed herein can use existing or future developed catalytic reforming units in a more efficient manner, and minimizes or eliminates problems associated with yield loss. The current practice leads to unnecessarily higher requisite capacity for the reforming unit, and corresponding catalyst and hydrogen requirements. In addition, isoparaffins are subject to cracking in the reforming unit, resulting in yield loss. Aromatics and isoparaffins have high octane numbers and there is no need to send these streams to a reforming unit.

In the present disclosure distinct separation steps are integrated upstream of the catalytic reformer to separate high value aromatics in an aromatics extraction zone, therefore bypassing reforming. In addition, high value isoparaffins are separated in an adsorption zone and also bypass reforming. The remaining low octane stream is processed in the reforming unit. Therefore, only the low octane stream containing normal paraffins and naphthene compounds are processed in the reforming unit to increase the octane number. The reformate can be blended with all or a portion of the previously separated isoparaffins, or can be recycled to the aromatic separation unit. Accordingly, yield loss is minimized, and the requisite capacity of the reforming unit is reduced as compared to conventional processes that are based on the initial straight run naphtha.

Figure 2:
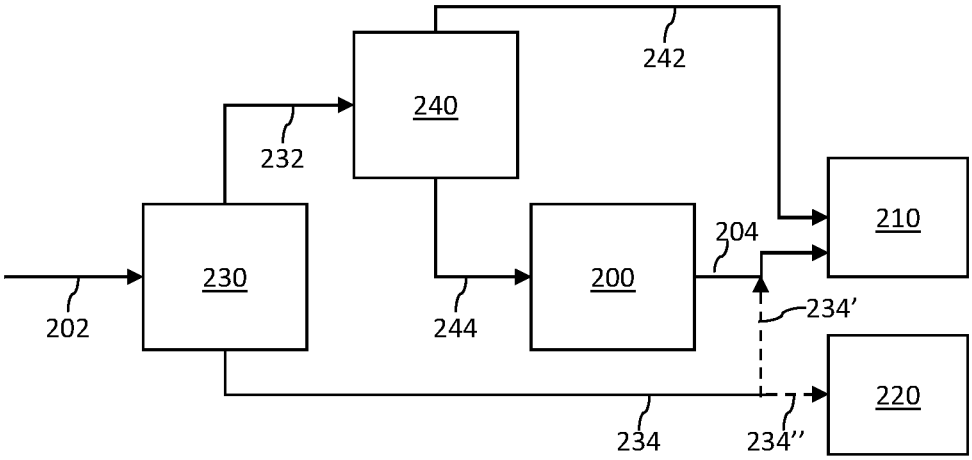
FIG. 2 is a process flow diagram of an embodiment of a process and system for conversion of gasoline-range hydrocarbons.

With reference to FIG. 2, an embodiment of an integrated reforming system for producing reformate is depicted. The system includes a separation zone 230 having one or more feed inlets in fluid communication with a source of a naphtha or heavy naphtha stream 202. The separation zone 230 includes at least two outlets, an aromatic-lean, raffinate outlet for discharging an aromatic-lean stream 232, and an aromatic-rich, extract outlet for discharging an aromatic-rich stream 234. The aromatic-lean outlet is in fluid communication with one or more inlets of an isoparaffin separation zone 240 and the aromatic-rich outlet is in fluid communication with one or more inlets of a gasoline pool 210 (stream 234') and/or an aromatic complex 220 (stream 234"). The isoparaffin separation zone 240 includes at least two outlets, a first outlet for discharging an isoparaffin rich stream 242, and a second outlet for discharging a stream 244 that is rich in normal paraffin and naphthene compounds. The first outlet for discharging the isoparaffin rich stream is in fluid communication with the gasoline pool 210, and the second outlet for discharging the stream rich in normal paraffin and naphthene compounds is in fluid communication with at least on one inlet of a reforming zone 200. The reforming zone 200 includes at least one outlet for discharging a reformate stream 204, which is in fluid communication with the gasoline pool 210.

In operation of the system depicted in FIG. 2, a naphtha or heavy naphtha stream 202 is fed to the separation zone 230 which is operable to produce the aromatic-lean stream 232 and the aromatic-rich stream 234. The aromatic-lean stream 232 is passed to the isoparaffin separation zone 240 for separation into the isoparaffin rich stream 242, and the stream 244 that is rich in normal paraffin and naphthene compounds. The aromatic-rich stream 234, from the separation zone 230, is passed to the gasoline pool 210 and/or the aromatic complex 220. In certain embodiments, 0-100, 25-100, or 50-100 V % of the aromatic-rich stream 234 is passed to the gasoline pool 210, and any remainder is passed to the aromatic complex 220. In certain embodiments, 0-100, 25-100, or 50-100 V % of the aromatic-rich stream 234 is passed to the aromatic complex 220, and any remainder is passed to the gasoline pool 210. In additional embodiments, an aromatic complex is not used and all of the aromatic-rich stream 234 is passed to the gasoline pool 210.

The isoparaffin rich stream 242 is passed to the gasoline pool 210. In certain embodiments the isoparaffin rich stream 242 is directed to the gasoline pool 210 without further processing if the octane number of the remaining gasoline blending pool components is sufficiently high so that the total blend meets the requisite octane number specification. The stream 244 that is rich in normal paraffin and naphthene compounds is passed to the reforming zone 200 for production of reformate. The reformate stream 204 from the reforming zone 200 is passed to the gasoline pool 210.

Figure 3:
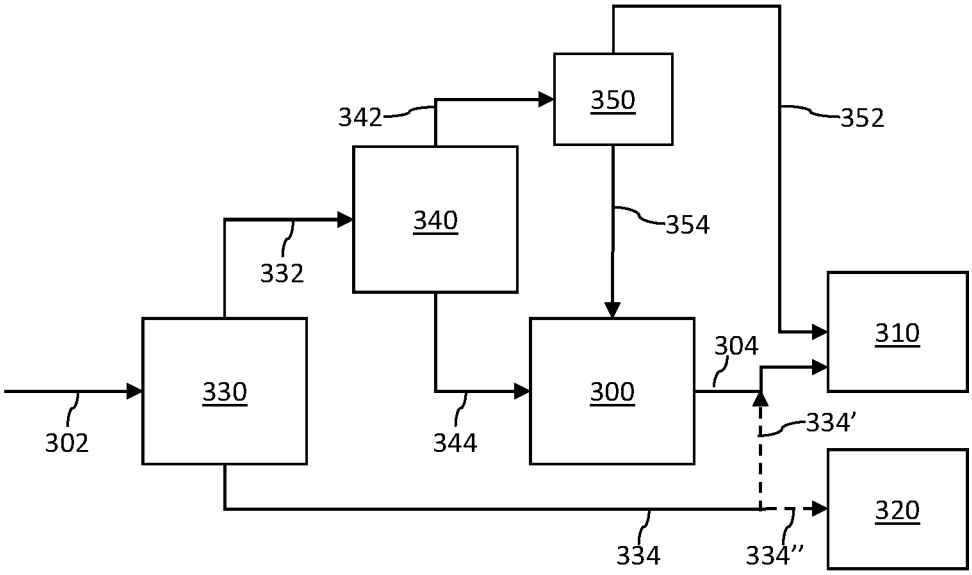
FIG. 3 is a process flow diagram of another embodiment of a process and system for conversion of gasoline-range hydrocarbons.

With reference to FIG. 3, another embodiment of an integrated reforming system for producing reformate is depicted including further separation of isoparaffins. The system includes a separation zone 330 having one or more feed inlets in fluid communication with a source of a naphtha or heavy naphtha stream 302. The separation zone 330 includes at least two outlets: an aromatic-lean, raffinate outlet for discharging an aromatic-lean stream 332, and an aromatic-rich, extract outlet for discharging an aromatic-rich stream 334. The aromatic-lean outlet is in fluid communication with one or more inlets of an isoparaffin separation zone 340 and the aromatic-rich outlet is in fluid communication with one or more inlets of a gasoline pool 310 (stream 334') and/or an aromatic complex 320 (stream 334"). The isoparaffin separation zone 340 includes at least two outlets, a first outlet for discharging an isoparaffin rich stream 342, and a second outlet for discharging a stream 344 that is rich in normal paraffin and naphthene compounds. The first outlet for discharging the isoparaffin rich stream is in fluid communication with one or more inlets of a separation zone 350, which includes a first outlet for discharging a light isoparaffin stream 352 and a second outlet for discharging a heavy isoparaffin stream 354. The first outlet of the separation zone 350 for discharging a light isoparaffin stream is in fluid communication with the gasoline pool 310. The second outlet of the isoparaffin separation zone 340 for discharging the stream rich in normal paraffin and naphthene compounds, and the second outlet of the separation zone 350 for discharging a heavy isoparaffin stream 354, are in fluid communication with at least on one inlet of a reforming zone 300. The reforming zone 300 includes at least one outlet for discharging a reformate stream 304, which is in fluid communication with the gasoline pool 310.

In operation of the system depicted in FIG. 3, a naphtha or heavy naphtha stream 302 is fed to the separation zone 330 which is operable to produce the aromatic-lean stream 332 and the aromatic-rich stream 334. The aromatic-lean stream 332 is passed to the isoparaffin separation zone 340 for separation into the isoparaffin rich stream 342, and the stream 344 that is rich in normal paraffin and naphthene compounds. The aromatic-rich stream 334, from the aromatics separation zone 330, is passed to the gasoline pool 310 and/or the aromatic complex 320. In certain embodiments, 0-100, 25-100, or 50-100 V % of the aromatic-rich stream 334 is passed to the gasoline pool 310, and any remainder is passed to the aromatic complex 320. In certain embodiments, 0-100, 25-100, or 50-100 V % of the aromatic-rich stream 334 is passed to the aromatic complex 320, and any remainder is passed to the gasoline pool 310. In additional embodiments, an aromatic complex is not used and all of the aromatic-rich stream 334 is passed to the gasoline pool 310.

The isoparaffin rich stream 342 is passed to the separation zone 350 that is operable to separate, for instance by flash separation, the isoparaffin rich stream 342 into the light isoparaffin stream 352, for instance C5-C7 isomerase, and the heavy isoparaffin stream 354, for instance C7+ isomerate. The light isoparaffin stream 352 is passed to the gasoline pool 310. In certain embodiments the light isoparaffin stream 352 is directed to the gasoline pool 210 without further processing. The stream 344 that is rich in normal paraffin and naphthene compounds from the isoparaffin separation zone 340, and the heavy isoparaffin stream 354 from the separation zone 350, are passed to the reforming zone 300 for production of reformate. The reformate stream 304 from the reforming zone 300 is passed to the gasoline pool 310.

Figure 4:
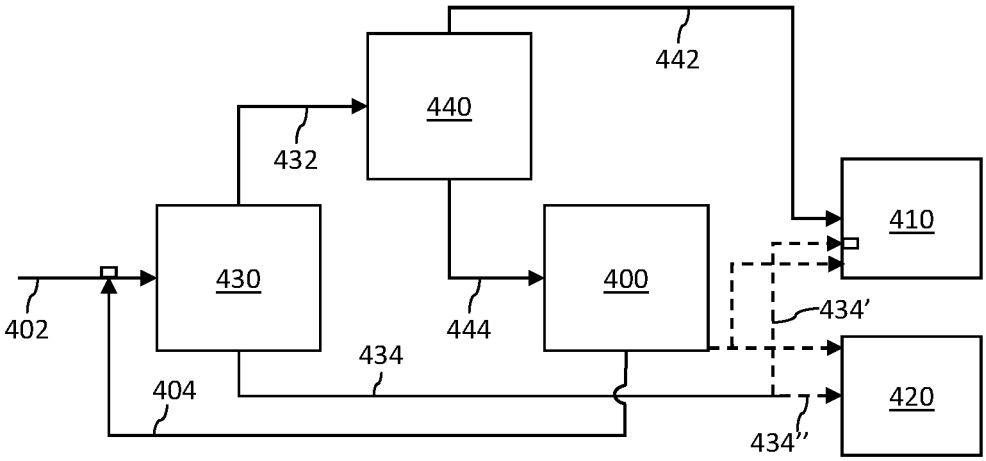
FIG. 4 is a process flow diagram of an additional embodiment of a process and system for conversion of gasoline-range hydrocarbons.

With reference to FIG. 4, a further embodiment of an integrated reforming system for producing reformate is depicted. The system includes a separation zone 430 having one or more feed inlets in fluid communication with a source of a naphtha or heavy naphtha stream 402. The separation zone 430 includes at least two outlets, an aromatic-lean, raffinate outlet for discharging an aromatic-lean stream 432, and an aromatic-rich, extract outlet for discharging an aromatic-rich stream 434. The aromatic-lean outlet is in fluid communication with one or more inlets of an isoparaffin separation zone 440 and the aromatic-rich outlet is in fluid communication with one or more inlets of a gasoline pool 410 (stream 434') and/or an aromatic complex 420 (stream 434"). The isoparaffin separation zone 440 includes at least two outlets, a first outlet for discharging an isoparaffin rich stream 442, and a second outlet for discharging a stream 444 that is rich in normal paraffin and naphthene compounds. The first outlet for discharging the isoparaffin rich stream is in fluid communication with the gasoline pool 410, and the second outlet for discharging the stream rich in normal paraffin and naphthene compounds is in fluid communication with at least on one inlet of a reforming zone 400. The reforming zone 400 includes at least one outlet for discharging a reformate stream 404, which is in fluid communication with the separation zone 430.

In operation of the system depicted in FIG. 4, a naphtha or heavy naphtha stream 402 is fed to the separation zone 430 which is operable to produce the aromatic-lean stream 432 and the aromatic-rich stream 434. The aromatic-lean stream 432 is passed to the isoparaffin separation zone 440 for separation into the isoparaffin rich stream 442, and the stream 444 that is rich in normal paraffin and naphthene compounds. The aromatic-rich stream 434 is passed to the gasoline pool 410 and/or the aromatic complex 420. In certain embodiments, 0-100, 25-100, or 50-100 V % of the aromatic-rich stream 434 is passed to the gasoline pool 410, and any remainder is passed to the aromatic complex 420. In certain embodiments, 0-100, 25-100, or 50-100 V % of the aromatic-rich stream 434 is passed to the aromatic complex 420, and any remainder is passed to the gasoline pool 410. In additional embodiments, an aromatic complex is not used and all of the aromatic-rich stream 434 is passed to the gasoline pool 410.

The isoparaffin rich stream 442 is passed to the gasoline pool 410. In certain embodiments the isoparaffin rich stream 442 directed to the gasoline pool 410 without further processing. The stream 444 that is rich in normal paraffin and naphthene compounds is passed to the reforming zone 400 for production of reformate. The reformate stream 404 from the reforming zone 400 is recycled to the separation zone 430. In certain embodiments, 0-100, 25-100, or 50-100 V % of the reformate stream 404 is recycled to the separation zone 430, and any remainder is passed to the gasoline pool 410 and/or the aromatic complex 420, at variable proportions, as shown in broken lines.

Figure 5:
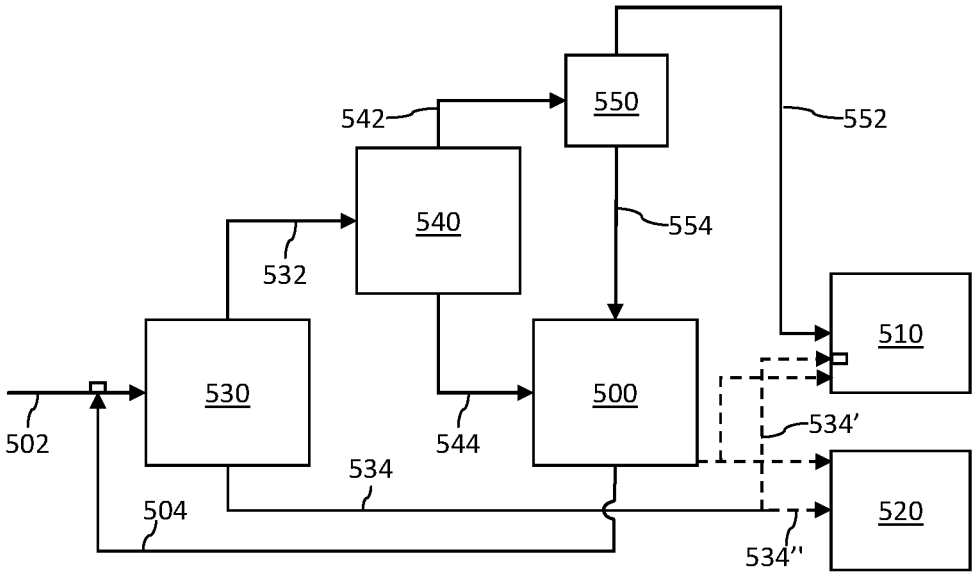
FIG. 5 is a process flow diagram of a further embodiment of a process and system for conversion of gasoline-range hydrocarbons.

With reference to FIG. 5, another embodiment of an integrated reforming system for producing reformate is depicted including further separation of isoparaffins. The system includes a separation zone 530 having one or more feed inlets in fluid communication with a source of a naphtha or heavy naphtha stream 502. The separation zone 530 includes at least two outlets, an aromatic-lean, raffinate outlet for discharging an aromatic-lean stream 532, and an aromatic-rich, extract outlet for discharging an aromatic-rich stream 534. The aromatic-lean outlet is in fluid communication with one or more inlets of an isoparaffin separation zone 540 and the aromatic-rich outlet is in fluid communication with one or more inlets of a gasoline pool 510 (stream 534') and/or an aromatic complex 520 (stream 534"). The isoparaffin separation zone 540 includes at least two outlets, a first outlet for discharging an isoparaffin rich stream 542, and a second outlet for discharging a stream 544 that is rich in normal paraffin and naphthene compounds. The first outlet for discharging the isoparaffin rich stream is in fluid communication with one or more inlets of a separation zone 550, which includes a first outlet for discharging a light isoparaffin stream 552 and a second outlet for discharging a heavy isoparaffin stream 554. The first outlet of the separation zone 550 for discharging a light isoparaffin stream is in fluid communication with the gasoline pool 510. The second outlet of the isoparaffin separation zone 540 for discharging the stream rich in normal paraffin and naphthene compounds, and the second outlet of the separation zone 550 for discharging a heavy isoparaffin stream 554, are in fluid communication with at least on one inlet of a reforming zone 500. The reforming zone 500 includes at least one outlet for discharging a reformate stream 504, which is in fluid communication with the separation zone 530.

In operation of the system depicted in FIG. 5, a naphtha or heavy naphtha stream 502 is fed to the separation zone 530 which is operable to produce the aromatic-lean stream 532 and the aromatic-rich stream 534. The aromatic-lean stream 532 is passed to the isoparaffin separation zone 540 for separation into the isoparaffin rich stream 542, and the stream 544 that is rich in normal paraffin and naphthene compounds. The aromatic-rich stream 534, from the aromatics separation zone 530, is passed to the gasoline pool 510 and/or the aromatic complex 520. In certain embodiments, 0-100, 25-100, or 50-100 V % of the aromatic-rich stream 534 is passed to the gasoline pool 510, and any remainder is passed to the aromatic complex 520. In certain embodiments, 0-100, 25-100, or 50-100 V % of the aromatic-rich stream 534 is passed to the aromatic complex 520, and any remainder is passed to the gasoline pool 510. In additional embodiments, an aromatic complex is not used and all of the aromatic-rich stream 534 is passed to the gasoline pool 510.

The isoparaffin rich stream 542 is passed to the separation zone 550 that is operable to separate, for instance by flash separation, the isoparaffin rich stream 542 into the light isoparaffin stream 552, for instance C5-C7 isomerate, and the heavy isoparaffin stream 554, for instance C7+ isomerate. The light isoparaffin stream 552 is passed to the gasoline pool 510. In certain embodiments the light isoparaffin stream 552 is directed to the gasoline pool 510 without further processing. The stream 544 that is rich in normal paraffin and naphthene compounds from the isoparaffin separation zone 540, and the heavy isoparaffin stream 554 from the separation zone 550, are passed to the reforming zone 500 for production of reformate. The reformate stream 504 from the reforming zone 500 is recycled to the separation zone 530. In certain embodiments, 0-100, 25-100, or 50-100 V % of the reformate stream 504 is recycled to the separation zone 530, and any remainder is passed to the gasoline pool 510 and/or the aromatic complex 520, at variable proportions, as shown in broken lines.

Figure 6:
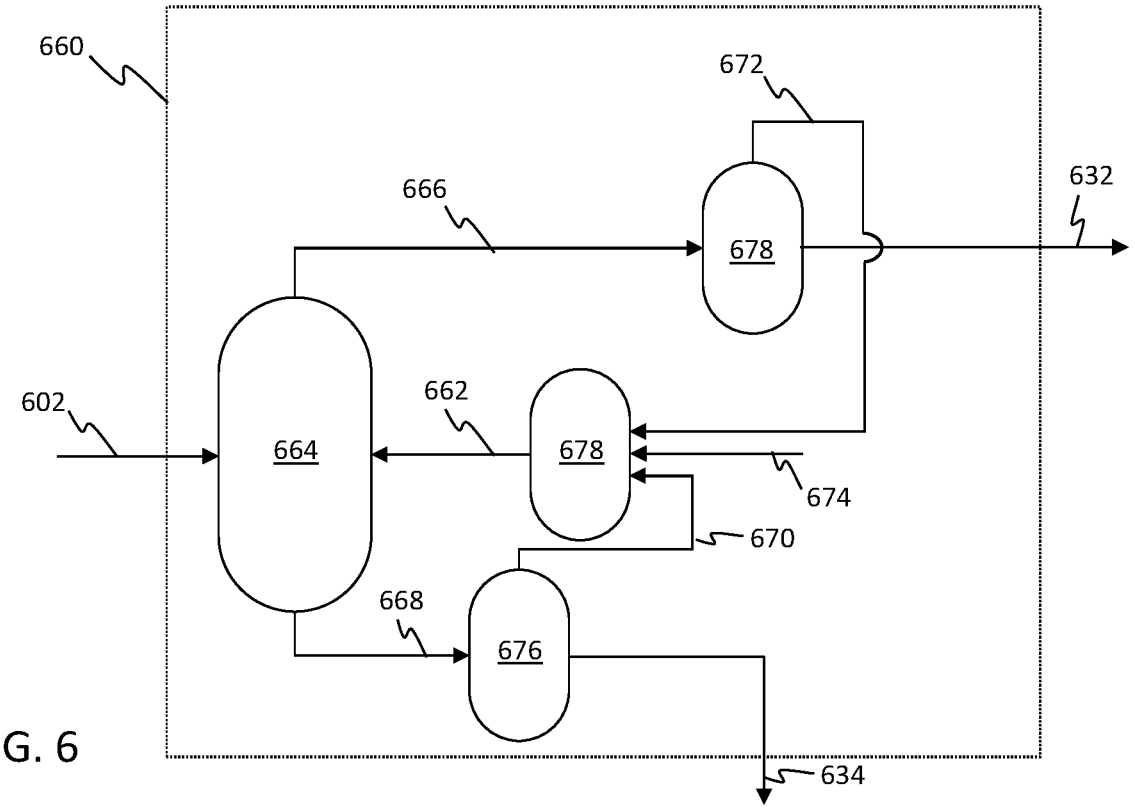
FIG. 6 is a schematic diagram of an aromatic separation apparatus.

The separation zone 230, 330, 430 and 530 can be any suitable unit or arrangement of units operable to separate the naphtha feed into an aromatic-rich stream and an aromatic-lean stream. As shown in FIG. 6, an aromatic separation apparatus 660 can include suitable unit operations to perform a solvent extraction of aromatics, and recover solvents for reuse in the process. A naphtha feed 602 is conveyed to an aromatic extraction vessel 664 in which a first, aromatic-lean, fraction is separated as a raffinate stream 666 from a second, generally aromatic-rich, fraction as an extract stream 668. The raffinate stream 666 contains at least a major proportion of the non-aromatic components of the naphtha feed 602, and the extract stream 668 contains at least a major proportion of the aromatic components of the naphtha feed 602. A solvent feed 662 is introduced into the aromatic extraction vessel 664. Solvent feed 662 includes the recycle solvent streams 670 and 672, an initial solvent feed and/or make-up solvent stream 674.

In certain embodiments, extraction solvent is typically separated from the extract and raffinate. For instance a portion of the extraction solvent is in stream 668, e.g., in the range of about 70 W % to 98 W % (based on the total amount of stream 662), in certain embodiments less than about 85 W %. In embodiments in which solvent existing in stream 668 exceeds a desired or predetermined amount, solvent can be removed via a separation zone 676 from the hydrocarbon product, for example, including flashing and/or stripping units, or other suitable apparatus. Solvent 670 from the separation zone 676 can be recycled to the aromatic extraction vessel 664, e.g., via a surge drum 678. An aromatic-rich stream 634 is discharged from the separation zone 676.

In addition, a portion of the extraction solvent can also exist in stream 666, e.g., in the range of about 0 W % to about 15 W % (based on the total amount of stream 666), in certain embodiments less than about 8 W %. In operations in which the solvent existing in stream 666 exceeds a desired or predetermined amount, solvent can be removed via a separation zone 678 from the hydrocarbon product, for example, including flashing and/or stripping units, or other suitable apparatus. Solvent 672 from the separation zone 678, can be recycled to the aromatic extraction vessel 664, e.g., via the surge drum 678. An aromatic-lean stream 632 is discharged from the separation zone 678.

Selection of extraction solvent, operating conditions, and the mechanism of contacting the solvent and feed, permit control over the level of aromatic extraction. For instance, suitable solvents include furfural, N-methyl-2-pyrrolidone, dimethylformamide, oxidized disulfide oil, dimethylsulfoxide, phenol, nitrobenzene, sulfolanes, acetonitrile, or glycols. Suitable glycols include diethylene glycol, ethylene glycol, triethylene glycol, tetraethylene glycol, dipropylene glycol and combinations comprising at least two of the foregoing. The extraction solvent can be a pure glycol or a glycol diluted with from about 2 to 10 W % water. Suitable sulfolanes include hydrocarbon-substituted sulfolanes (e.g., 3-methyl sulfolane), hydroxy sulfolanes (e.g., 3-sulfolanol and 3-methyl-4-sulfolanol), sulfolanyl ethers (i.e., methyl-3-sulfolanyl ether), and sulfolanyl esters (e.g., 3-sulfolanyl acetate). The total extraction solvent can be provided in a solvent to oil ratio (W:W) of about 20:1-1:1, 10:1-1:1, 5:1-1:1 or 4:1 to 1:1.

The aromatic separation apparatus can operate at a temperature in the range of from about 20-200, 20-100, 20-80, 40-200, 40-100 or 40-80° C. The operating pressure of the aromatic separation apparatus can be in the range of from about 1-10, 1-8 or 1-3 bars. Types of apparatus useful as the aromatic separation apparatus in certain embodiments of the system and process described herein include stage-type extractors or differential extractors.

Figure 7:
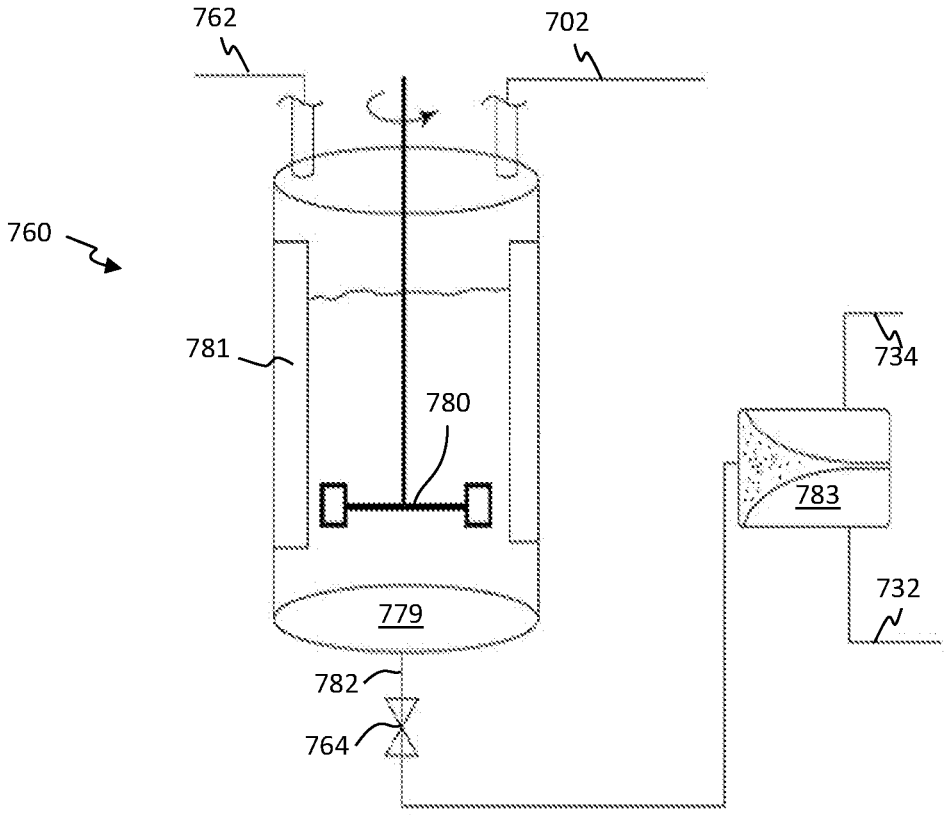
FIGS. 7-11 are schematic diagrams of embodiments of liquid-liquid solvent extraction processes for use in the processes and systems for conversion of gasoline-range hydrocarbons herein.

An example of a stage-type extractor is a mixer-settler apparatus 760 schematically illustrated in FIG. 7. Mixer-settler apparatus 760 includes a vertical tank 779 incorporating a turbine or a propeller agitator 780 and one or more baffles 781. Charging inlets 702, 762 are located at the top of a tank 779 and an outlet 782 is located at the bottom of the tank 779. The feedstock to be extracted is charged into the tank 779 via the inlet 702 and a suitable quantity of solvent is added via the inlet 762. The bottoms fraction to be extracted and recycled is charged into the vessel 779 via the inlet 702 and a suitable quantity of solvent is added via the inlet 762. The agitator 780 is activated for a period of time sufficient to cause intimate mixing of the solvent and charge stock, and at the conclusion of a mixing cycle, agitation is halted and, by control of a valve 764, at least a portion of the contents are discharged and passed to a settler 783. The phases separate in the settler 783 and a raffinate phase containing an aromatic-lean hydrocarbon mixture and an extract phase containing an aromatic-rich mixture are withdrawn via outlets 732 and 734, respectively. In general, a mixer-settler apparatus can be used in batch mode, or a plurality of mixer-settler apparatus can be staged to operate in a continuous mode.

Another stage-type extractor is a centrifugal contactor. Centrifugal contactors are high-speed, rotary machines characterized by relatively low residence time. The number of stages in a centrifugal device is usually one, however, centrifugal contactors with multiple stages can also be used. Centrifugal contactors utilize mechanical devices to agitate the mixture to increase the interfacial area and decrease the mass transfer resistance.

Various types of differential extractors (also known as "continuous contact extractors,") that are also suitable for use as an aromatic extraction apparatus include, but are not limited to, centrifugal contactors and contacting columns such as tray columns, spray columns, packed towers, rotating disc contactors and pulse columns.

Contacting columns are suitable for various liquid-liquid extraction operations. Packing, trays, spray or other droplet-formation mechanisms or other apparatus are used to increase the surface area in which the two liquid phases (i.e., a solvent phase and a hydrocarbon phase) contact, which also increases the effective length of the flow path. In column extractors, the phase with the lower viscosity is typically selected as the continuous phase, which, in the case of an aromatic extraction apparatus, is the solvent phase. In certain embodiments, the phase with the higher flow rate can be dispersed to create more interfacial area and turbulence. This is accomplished by selecting an appropriate material of construction with the desired wetting characteristics. In general, aqueous phases wet metal surfaces and organic phases wet non-metallic surfaces. Changes in flows and physical properties along the length of an extractor can also be considered in selecting the type of extractor and/or the specific configuration, materials or construction, and packing material type and characteristics (such as average particle size, shape, density, surface area, and the like).

Figure 8:
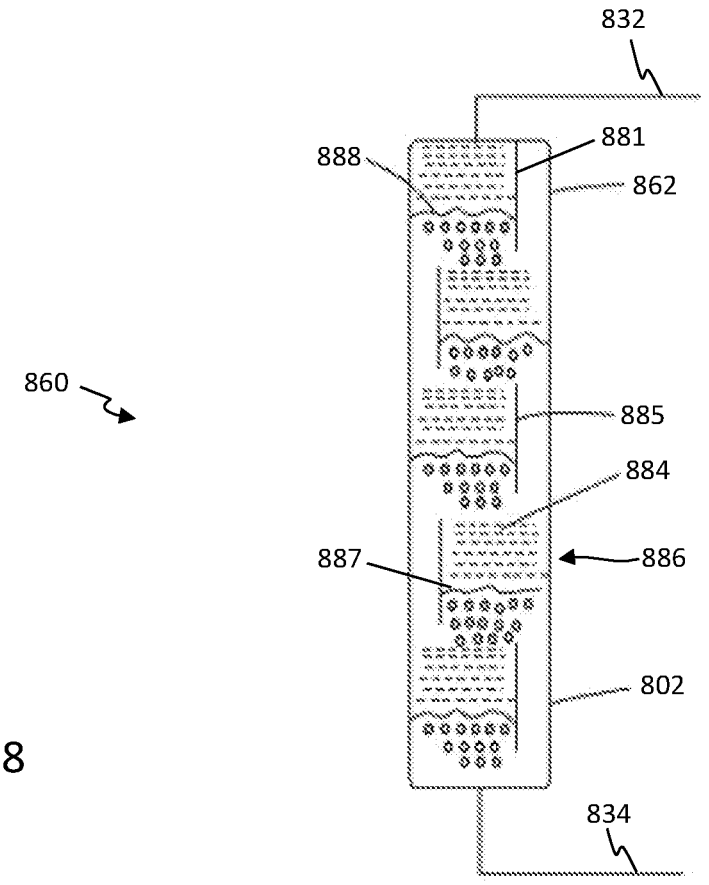

A tray column 860 is schematically illustrated in FIG. 8. A light liquid inlet 802 at the bottom of a column 860 receives the naphtha feedstock, and a heavy liquid inlet 862 at the top of the column 860 receives liquid solvent. The column 860 includes a plurality of trays 884 and associated downcomers 885. A top level baffle 881 physically separates incoming solvent from the liquid hydrocarbon that has been subjected to prior extraction stages in the column 860. The tray column 860 is a multi-stage counter-current contactor. Axial mixing of the continuous solvent phase occurs at a region 886 between trays 884, and dispersion occurs at each tray 884 resulting in effective mass transfer of solute into the solvent phase. The trays 884 can be sieve plates having perforations ranging from about 1.5 to 4.5 mm in diameter and can be spaced apart by about 150-600 mm.

Light hydrocarbon liquid passes through the perforation in each tray 884 and emerges in the form of fine droplets. The fine hydrocarbon droplets rise through the continuous solvent phase and coalesce into an interface layer 887 and are again dispersed through the tray 884 above. Solvent passes across each plate and flows downward from the tray 884 above to the tray 884 below via a downcomer 885. A principal interface 888 is maintained at the top of the column 860. Aromatic-lean hydrocarbon liquid is removed from the outlet 832 at the top of the column 860 and aromatic-rich solvent liquid is discharged through the outlet 834 at the bottom of the column 860. Tray columns are efficient solvent transfer apparatus and have desirable liquid handling capacity and extraction efficiency, particularly for systems of low-interfacial tension.

Figure 9:
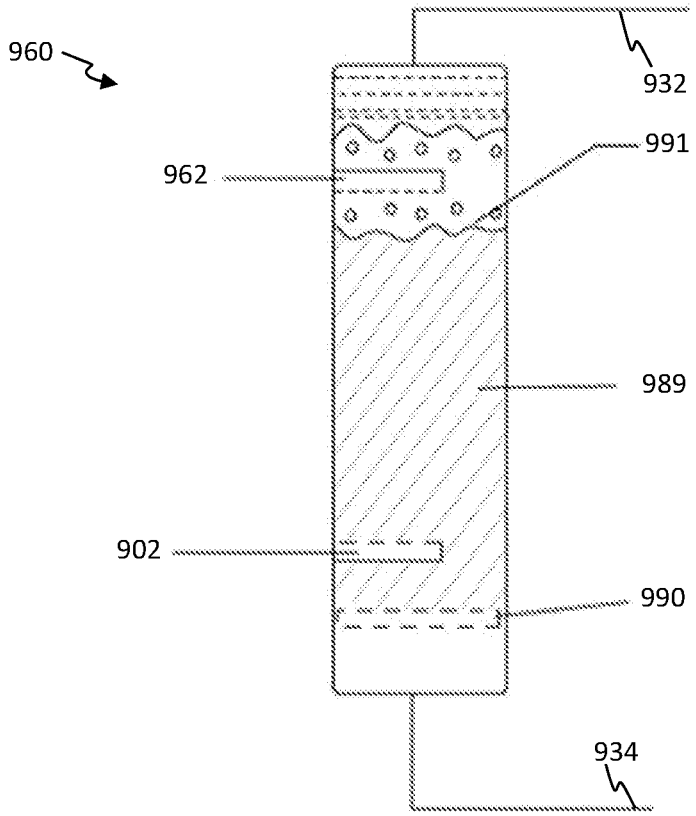

An additional type of unit operation suitable for extracting aromatics from the hydrocarbon feed is a packed bed column. FIG. 9 is a schematic illustration of a packed bed column 960 having a light liquid inlet 902 and a solvent inlet 962. A packing region 989 is provided upon a support plate 990. The packing region 989 comprises suitable packing material including, but not limited to, Pall rings, Raschig rings, Kascade rings, Intalox saddles, Berl saddles, super Intalox saddles, super Berl saddles, Demister pads, mist eliminators, telerrettes, carbon graphite random packing, other types of saddles, and the like, including combinations of one or more of these packing materials. The packing material is selected so that it is fully wetted by the continuous solvent phase. The solvent introduced via the inlet 962 at a level above the top of the packing region 989 flows downward and wets the packing material and fills a large portion of void space in the packing region 989. Remaining void space is filled with droplets of the hydrocarbon liquid which rise through the continuous solvent phase and coalesce to form the liquid-liquid interface 991 at the top of the packed bed column 960. Aromatic-lean hydrocarbon liquid is removed from the outlet 932 at the top of column 960 and aromatic-rich solvent liquid is discharged through the outlet 934 at the bottom of column 960. Packing material provides large interfacial areas for phase contacting, causing the droplets to coalesce and reform. The mass transfer rate in packed towers can be relatively high because the packing material lowers the recirculation of the continuous phase.

Figure 10:
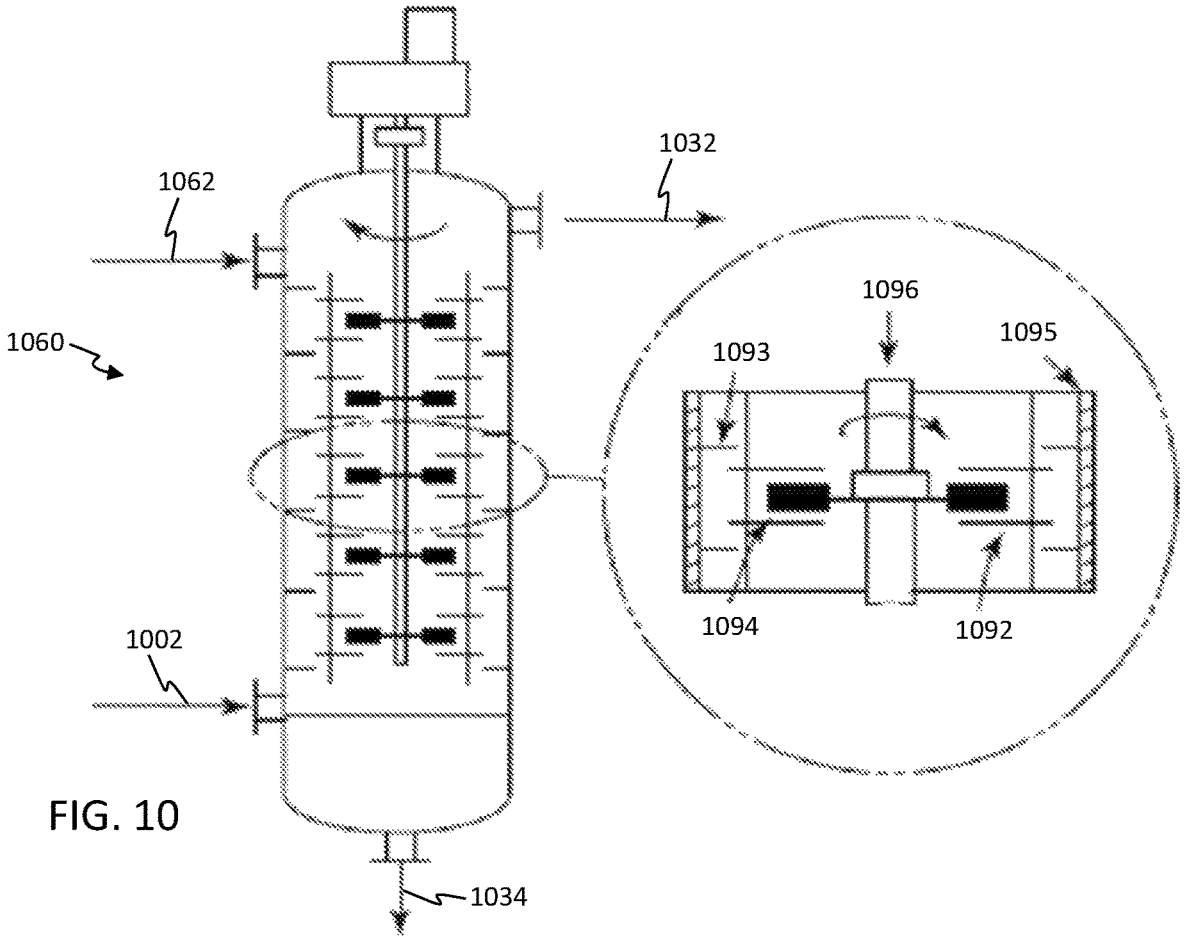

Further types of apparatus suitable for aromatic extraction in the system and method herein include rotating disc contactors. FIG. 10 is a schematic illustration of a rotating disc contactor 1060 known as a Scheibel® column commercially available from Koch Modular Process Systems, LLC of Paramus, N.J., USA. It will be appreciated by those of ordinary skill in the art that other types of rotating disc contactors can be implemented as a liquid-liquid solvent extraction unit included in the system and method herein, including but not limited to Oldshue-Rushton columns, and Kuhni extractors. The rotating disc contactor is a mechanically agitated, counter-current extractor. Agitation is provided by a rotating disc mechanism, which typically runs at much higher speeds than a turbine type impeller as described with respect to FIG. 10.

The rotating disc contactor 1060 includes a light liquid inlet 1002 toward the bottom of the column and a solvent inlet 1062 proximate to the top of the column, and is divided into a number of compartments formed by a series of inner stator rings 1092 and outer stator rings 1093. Each compartment contains a centrally located, horizontal rotor disc 1094 connected to a rotating shaft 1096 that creates a high degree of turbulence inside the column. The diameter of the rotor disc 1094 is slightly less than the opening in the inner stator rings 1092. Typically, the disc diameter is 33-66% of the column diameter. The disc disperses the liquid and forces it outward toward the vessel wall 1095 where the outer stator rings 1093 create quiet zones where the two phases can separate. Aromatic-lean hydrocarbon liquid is removed from the outlet 1032 at the top of the column 1060 and aromatic-rich solvent liquid is discharged through the outlet 1034 at the bottom of the column 1060. Rotating disc contactors advantageously provide relatively high efficiency and capacity and have relatively low operating costs.

Figure 11:
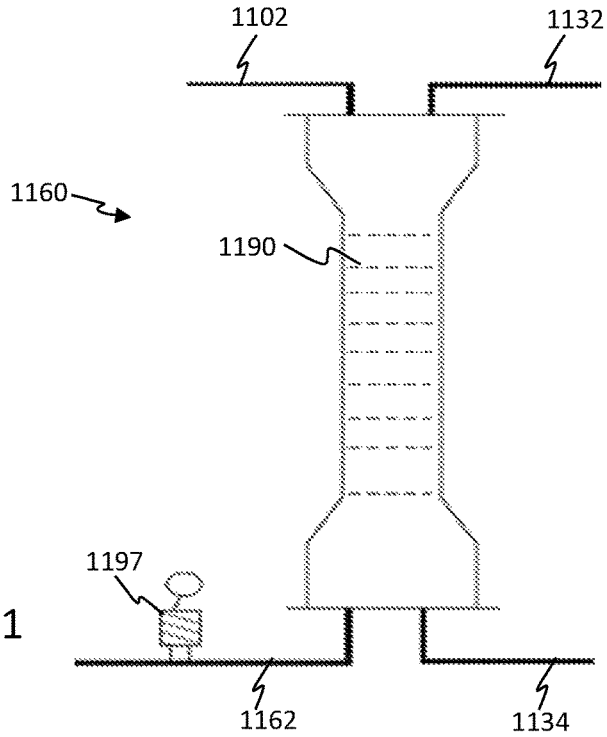

An additional type of apparatus suitable for aromatic extraction in the system and method herein is a pulse column. FIG. 11 is a schematic illustration of a pulse column system 1160, which includes a column with a plurality of packing or sieve plates 1190, a solvent inlet 1162, liquid feed, inlet 1102, a light phase outlet 1132 for discharging an aromatic-lean hydrocarbon liquid and a heavy phase outlet 1134 for discharging an aromatic-rich solvent liquid.

In general, the pulse column system 1160 is a vertical column with a large number of sieve plates 1190 lacking downcomers. The perforations in the sieve plates 1190 typically are smaller than those of non-pulsating columns, e.g., about 1.5 mm to 3.0 mm in diameter.

A pulse-producing device 1197, such as a reciprocating pump, pulses the contents of the column at frequent intervals. The rapid reciprocating motion, of relatively small amplitude, is superimposed on the usual flow of the liquid phases. Bellows or diaphragms formed of coated steel (e.g., coated with polytetrafluoroethylene), or any other reciprocating, pulsating mechanism can be used. A pulse amplitude of 5-25 mm is generally recommended with a frequency of 100-260 cycles per minute. The pulsation causes the light liquid (solvent) to be dispersed into the heavy phase (oil) on the upward stroke and heavy liquid phase to jet into the light phase on the downward stroke. The column has no moving parts, low axial mixing, and high extraction efficiency. A pulse column typically requires less than a third the number of theoretical stages as compared to a non-pulsating column. A specific type of reciprocating mechanism is used in a Karr Column, for example.

The isoparaffin separation zone 240, 340, 440 and 540 can be any suitable unit or arrangement of units operable to separate isoparaffins from the mixture containing isoparaffins, normal paraffins and naphthenes. These can include adsorption-desorption separation processes and/or fractional distillation processes.

In certain embodiments, isoparaffin separation includes an adsorption process to selectively adsorb normal paraffins and naphthenes. This separation method relies on the pore size of the adsorbent material, due to the relatively smaller molecular diameter of normal paraffins compared to isoparaffins. Suitable adsorbents include fresh or partially spent adsorbents selected from the group consisting of molecular sieves, activated carbon, silica gel, alumina, natural clays including attapulgus clay, silica-alumina, natural and synthetic zeolites and combinations comprising one or more of the foregoing. For instance, molecular sieves having an average pore diameter of 5 angstroms is known as a suitable adsorbent material for selective adsorption of normal paraffins and naphthenes, and rejection of higher octane isoparaffins.

An adsorption step is followed by a desorption step for net recovery of normal paraffins and naphthenes, for instance using heat, pressure and/or solvent. These steps are carried out cyclically or pseudo-continuously. In certain embodiments additional fluid streams are used for the desorption and delivery steps. In certain embodiments, pressure swing adsorption processes are effective.

In additional embodiments, isoparaffin separation includes one or more fractional distillation columns for separating straight chain paraffins from branched paraffins. In certain embodiments one or more separation sections are provided for separating singly branched paraffins from paraffins with two or more branches. For instance, straight chain C5 and/or C6 paraffins in the aromatic-lean stream can be separated from branched C5 and/or C6 paraffins. In additional embodiments, straight chain paraffins and singly branched C6 paraffins in the aromatic-lean stream can be separated from C6 paraffins having two or more branches.

While not shown, the skilled artisan will understand that additional equipment, including exchangers, furnaces, pumps, columns, and compressors to feed the reactors, to maintain proper operating conditions, and to separate reaction products, are all part of the systems described.

Example: A process following the scheme of FIG. 3 was carried out. A quantity of 100 Kg of straight run naphtha having a Research Octane Number (RON) of 37.4 and boiling in the range 36-180° C. is separated into an aromatics-rich stream and an aromatics-lean stream in an aromatic extraction column. A quantity of 14 Kg was recovered as the aromatics-rich stream, with a RON of 103.5, and was passed to the gasoline pool. A quantity of 86 Kg was recovered as the aromatics-lean stream, with a RON of 26.7, and was passed to an isoparaffin separation step. A quantity of 33 Kg of iso-paraffins with a RON of 44 was recovered and sent to the flash step. A quantity of 10 Kg of the light isoparaffins (C5-C7) with a RON of 70.2 was recovered and sent to the gasoline pool. A quantity of 23 Kg of the heavy isoparaffins ($C_7$+) with a RON of 34 was recovered and sent to the reforming step for further improvement. A quantity of 53 Kg of the fraction containing normal paraffins (37.3 Kg) and naphthenes (15.7 Kg) with a RON of 15.4 is also sent to the reforming unit for further octane improvement. Including the separation step as disclosed herein reduced the required reforming unit capacity by 24%. The reformer produced 60.8 Kg of reformate having a RON of 95.

The methods and systems of the present invention have been described above and in the attached drawings; however, modifications will be apparent to those of ordinary skill in the art and the scope of protection for the invention is to be defined by the claims that follow.

The invention claimed is:

1. An integrated process for producing gasoline blending components comprising:

separating a naphtha feedstream into an aromatic-rich stream and an aromatic-lean stream;

separating the aromatic-lean stream into an isoparaffin-rich stream and an isoparaffin-lean stream; and catalytically reforming the isoparaffin-lean stream by dehydrogenation of naphthenes to aromatics, isomerization of n-paraffins to iso-paraffins, and dehydrocyclization of paraffins to aromatics, to produce a reformate stream.

2. The process as in claim 1, further comprising recovering at least a portion of the isoparaffin-rich stream as gasoline blending components.

3. The process as in claim 1, further comprising recovering at least a portion of the aromatic-rich stream as gasoline blending components.

4. The process as in claim 1, further comprising passing at least a portion of the aromatic-rich stream to an aromatic complex for recovery of aromatic products.

5. The process as in claim 1, further comprising recovering at least a portion of the reformate stream as gasoline blending components.

6. The process as in claim 1, further comprising passing at least a portion of the reformate stream to the step of separating the naphtha feedstream.

7. The process as in claim 1, further comprising separating at least a portion of the isoparaffin rich stream into a light isoparaffin rich stream and a heavy isoparaffin rich stream, recovering at least a portion of the light isoparaffin rich stream as gasoline blending components, and passing at least a portion of the heavy isoparaffin rich stream to the step of catalytically reforming.

8. The process as in claim 1, wherein separating the naphtha feedstream into an aromatic-lean fraction and an aromatic-rich fraction comprises:

subjecting the naphtha feedstream and an effective quantity of extraction solvent to an extraction zone to produce an extract containing a major proportion of the aromatic content of the hydrocarbon feed and a portion of the extraction solvent, and a raffinate containing a major proportion of the non-aromatic content of the hydrocarbon feed and a portion of the extraction solvent;

separating at least a substantial portion of the extraction solvent from the raffinate and recovering the aromatic-lean fraction; and separating at least a substantial portion of the extraction solvent from the extract and recovering the aromatic-rich fraction.

9. The process as in claim 8, wherein the extraction solvent is selected from the group consisting of furfural, N-methyl-2-pyrrolidone, dimethylformamide, oxidized disulfide oil, dimethylsulfoxide, phenol, nitrobenzene, sulfolanes, acetonitrile, glycols and combinations comprising at least two of the foregoing.

10. The process as in claim 1, wherein separating the aromatic-lean stream into the isoparaffin-rich stream and the isoparaffin-lean stream comprises adsorbing on an adsorbent material normal paraffin and naphthene compounds from the aromatic-lean stream while rejecting isoparaffin compounds pass with the isoparaffin-rich stream, and desorbing the adsorbent material to recover the iso-paraffin lean stream.

11. An integrated system for producing gasoline blending components comprising:

a first separation zone operable to separate a naphtha feedstream into an aromatic-rich stream and an aromatic-lean stream, the first separation zone comprising one or more feed inlets in fluid communication with a source of the naphtha feedstream, one or more first outlets for discharging the aromatic-rich stream, one or more second outlets for discharging the aromatic-lean stream;

a second separation zone operable to separate the aromatic-lean stream into an isoparaffin-rich stream and an isoparaffin-lean stream, the second separation zone comprising one or more inlets in fluid communication with the second outlet of the first separation zone, one or more first outlets for discharging the isoparaffin-rich stream, and one or more second outlets for discharging the isoparaffin-lean stream; and a catalytic reforming zone operable to produce a reformate comprising at least one inlet in fluid communication with the second outlet of the second separation zone; and at least one outlet for discharging reformate, said catalytic reforming zone selected from a semi-regenerative unit, a cyclic regeneration unit, and a continuous catalyst regeneration unit.

12. The system as in claim 11, further comprising a gasoline pool comprising at least one inlet, said at least one inlet of the gasoline pool being in fluid communication with the first outlet of the second separation zone.

13. The system as in claim 11, further comprising a gasoline pool comprising at least one inlet, said at least one inlet of the gasoline pool being in fluid communication with the first outlet of the first separation zone.

14. The system as in claim 11, further comprising an aromatic complex comprising at least one inlet in fluid communication with the first outlet of the first separation zone, and at least one outlet for discharging aromatic products.

15. The system as in claim 11, further comprising a gasoline pool comprising at least one inlet, said at least one inlet of the gasoline pool being in fluid communication with the catalytic reforming zone outlet.

16. The system as in claim 11, wherein the catalytic reforming zone outlet is in fluid communication with the feed inlet of the first separation zone.

17. The system as in claim 11, further comprising:

a third separation zone operable to separate the paraffin-rich stream into a light isoparaffin-rich stream and a heavy isoparaffin-rich stream, the third separation zone comprising one or more inlets in fluid communication with the first outlet of the second separation zone, one or more first outlets for discharging the light isoparaffin-rich stream, and one or more second outlets for discharging the heavy isoparaffin-rich stream; and wherein the second outlet of the third separation zone is in fluid communication with the catalytic reforming zone inlet.

18. The system as in claim 11, wherein the first separation zone is selected from the group consisting of mixer-settlers, centrifugal contactors, tray columns, packed bed columns, rotating disc contactors or pulse columns.

19. The system as in claim 11, wherein the second separation zone comprises an adsorbent treatment zone containing an effective quantity of adsorbent material and operable to selectively adsorb normal paraffin and naphthene compounds from the aromatic-lean stream, wherein rejected isoparaffin compounds are discharged from the first outlet, and wherein paraffin and naphthene compounds are desorbed and discharged from the second outlet.

* * * * *